US005274206A

United States Patent [19]

Milianowicz

[11] Patent Number: 5,274,206

[45] Date of Patent: Dec. 28, 1993

[54] SPRING CHARGING MECHANISM FOR CIRCUIT BREAKERS AND TRANSFER SWITCHES

[75] Inventor: Stanislaw A. Milianowicz, Monroeville, Pa.

[73] Assignee: Westinghouse Electric Corp., Pittsburgh, Pa.

[21] Appl. No.: 874,861

[22] Filed: Apr. 28, 1992

[51] Int. Cl.[5] ..... H01H 5/04

[52] U.S. Cl. ..... 200/400; 200/305

[58] Field of Search ..... 200/400, 305; 74/577 R, 74/575, 142, 143; 192/46; 403/316, 318, 319

[56] References Cited

U.S. PATENT DOCUMENTS

| | | | |
|---|---|---|---|
| 2,431,387 | 11/1947 | Fiorenza | 403/316 X |
| 3,236,967 | 2/1966 | Bottonari et al. | 200/400 X |
| 3,652,815 | 3/1972 | Davies . | |
| 3,689,721 | 9/1972 | McGuffie . | |
| 3,773,995 | 11/1973 | Davies . | |
| 3,806,684 | 4/1974 | Hauser | 200/400 |
| 4,110,582 | 8/1978 | Barkan . | |
| 4,146,764 | 3/1979 | Wilson . | |
| 4,163,133 | 7/1979 | Bould . | |
| 4,167,988 | 9/1979 | Acampora et al. | 185/40 R |
| 4,359,611 | 11/1982 | Haskins | 200/339 X |
| 4,404,446 | 9/1983 | Maier et al. | 200/320 |
| 4,409,449 | 10/1983 | Takano et al. . | |
| 4,523,769 | 6/1985 | Glaser et al. | 74/143 X |
| 4,575,592 | 3/1986 | Rose | 200/339 X |
| 4,587,390 | 5/1986 | Gray | 200/400 |
| 4,596,310 | 6/1986 | Hatakeyama et al. | 185/40 R |
| 4,742,200 | 5/1988 | Marquardt et al. | 200/325 |

*Primary Examiner*—Renee S. Luebke

*Attorney, Agent, or Firm*—M. J. Moran

[57] ABSTRACT

A spring charging mechanism for electrical circuit breakers and transfer switches of the type in which a spring is charged by rotation of a shaft. The charging mechanism has a charging shaft with two independently operating ratchet mechanisms coupled thereto. One ratchet mechanism may be driven by hand while the other may be separately motor-driven or held stationary by a bracket. The ratchet mechanism which is not in operation acts as a locking device which prevents rotation of the charging shaft in the discharge direction while allowing rotation in the charging direction. The charging mechanism is adaptable for either hand or motor-driven operation or both. It also features an inexpensive and easily installed flexible, resilient, insulating sleeve which insulates the charging mechanism from the operator, and a key arrangement for coupling a handle to a ratchet mechanism which distributes stress within the handle and protects the handle fastening screws from destructive shear stresses.

11 Claims, 5 Drawing Sheets

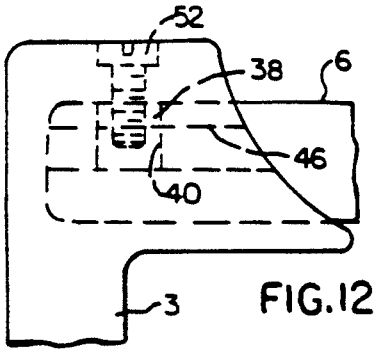
FIG.12.
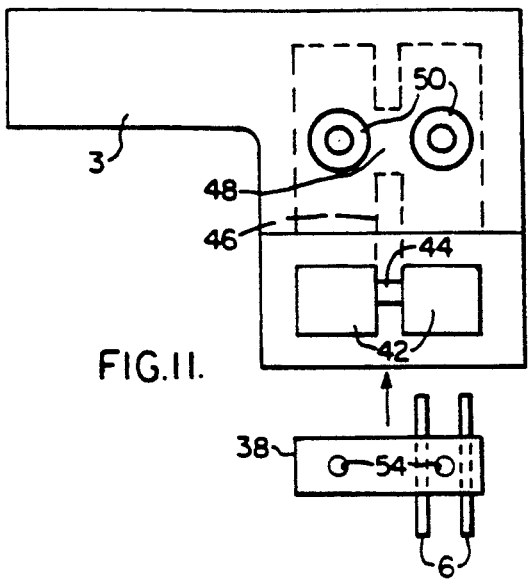
FIG.11.
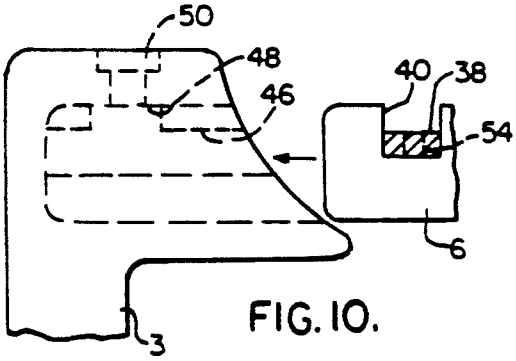
FIG.10.
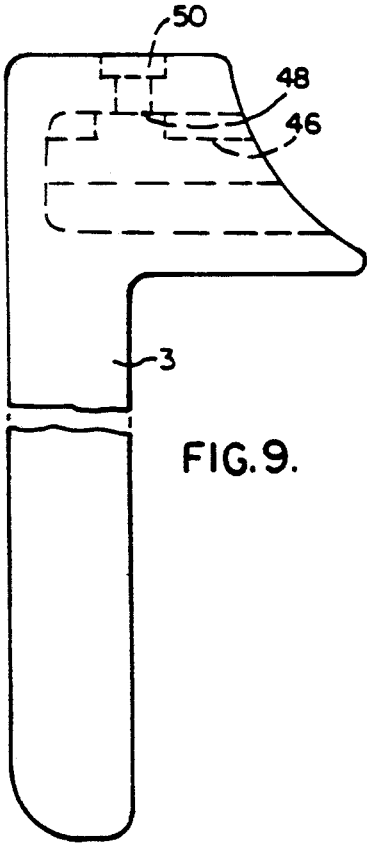
FIG.9.
FIG.8.
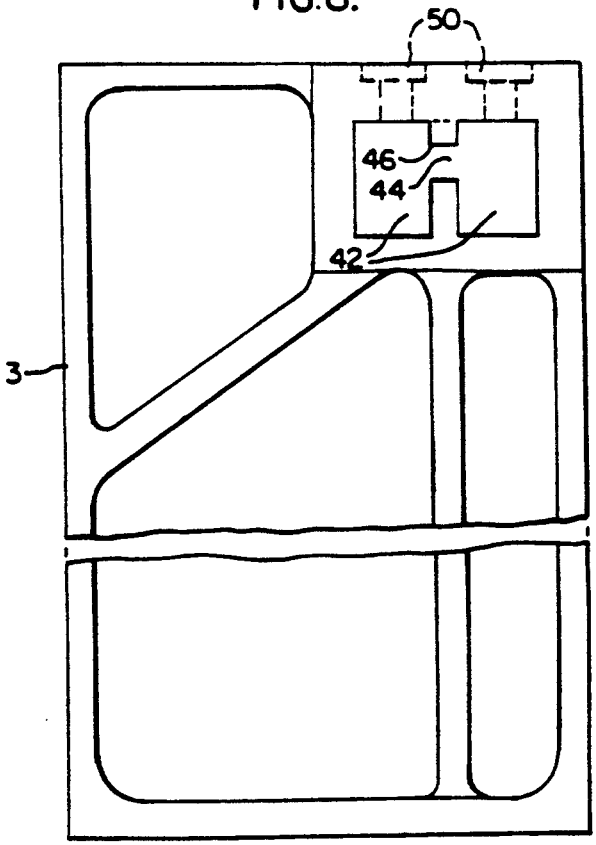

SPRING CHARGING MECHANISM FOR CIRCUIT BREAKERS AND TRANSFER SWITCHES

BACKGROUND OF THE INVENTION

This invention relates generally to single or multipole circuit breakers and transfer switches, and more particularly to stored energy circuit breakers and transfer switches.

The basic functions of these devices are to provide separable electrical contact switching to make or break electrical connections in circuits. Circuit breakers are typically designed to detect abnormal conditions in circuits and make or break electrical connections in response to those conditions. Circuit breakers also usually may be switched on or off manually. Transfer switches have a similar function in switching electrical connections in response to manual or signal inputs or predetermined electrical conditions.

The operating voltage, continuous current, frequency, short circuit interrupting capability, and time-current coordination needed are some of the factors which must be considered when designing one of these devices. Government and market requirements are placing increasing demands upon the electrical industry for breakers and switches with improved performance in smaller packages and with numerous new and novel features.

Stored energy mechanisms for use in circuit breakers and transfer switches of the single pole or multi-pole type are known in the art- A particular construction of such mechanisms is primarily dependent upon a parameter such as the rating of the breaker. A variety of mechanical arrangements are known which utilize mechanical energy stored in a biasing device such as a spring. The stored mechanical energy is used to provide the mechanical force necessary to drive a latch and trip mechanism which opens and closes separable contacts, which function to make or break electrical connections in the circuit.

Such a device also necessarily includes means for charging the spring—storing mechanical energy to be released later in operation of the device. Such means have included electric motor-driven charging mechanisms as well as manually-operated charging mechanisms, or both.

One type of circuit breaker design utilizes mechanical linkages coupled to a rotating shaft to charge a spring. An example of this type can be seen in U.S. Pat. No. 4,404,446 issued Sept. 13, 1983 to Maier et al. This design comprises a rotating charging shaft which exits the latch and trip mechanism of the breaker, rotation of the shaft by an applied force being the means by which the spring of the breaker is charged.

This shaft must be rotated by a mechanism which prevents rotation in the reverse direction, i.e., which allows rotation in only one direction. This "locking" is necessary to prevent loss of stored mechanical energy through rotation of the shaft in a direction opposite the charging direction—to prevent the spring from discharging.

Prior to the invention disclosed herein, the means used to supply the rotational charging force and locking function consisted of a complex and expensive clutch-drive mechanism. It would therefore be advantageous to employ a device to perform these functions which is inexpensive to manufacture and quickly adaptable to manual charging, motor-driven charging, or both.

SUMMARY OF THE INVENTION

This invention comprises an electrical switching device having a simplified and inexpensively-manufactured means for providing rotational spring-charging force and charging shaft locking function. The invention is adaptable for motor-driven application, manually operated application, or both. The parts of the charging means may be manufactured by inexpensive stamping methods.

An electrical switching device having a rotating spring-charging shaft is disclosed. The shaft has coupled to it a pair of ratchet-drive mechanisms, each of which may be rotated independently of the other to turn the shaft. One ratchet-drive mechanism may be coupled to a handle for manual charging, while the other may be coupled to a holding bracket or to the gearbox of a motor-driven charging unit. The handle is limited in its range of motion by the circuit breaker housing. The result of this arrangement is that one ratchet-mechanism will be held stationary and will prevent reverse rotation of the charging shaft, while the other can be rotated, thus rotating the charging shaft and charging the spring.

BRIEF DESCRIPTION OF THE DRAWINGS

Reference is now made to the description of the preferred embodiment, illustrated in the accompanying drawings, in which:

FIG. 8 presents a rear view of the charging mechanism handle;

FIG. 9 presents a side view of the charging mechanism handle;

FIG. 10 presents a side view of the charging mechanism handle and ratchet handle members before assembly;

FIG. 11 presents a top view of the charging mechanism handle and ratchet handle members of FIG. 10 before assembly; and FIG. 12 presents a side view of the charging mechanism handle and ratchet handle members after assembly.

DESCRIPTION OF THE PREFERRED EMBODIMENT

Figure 1:
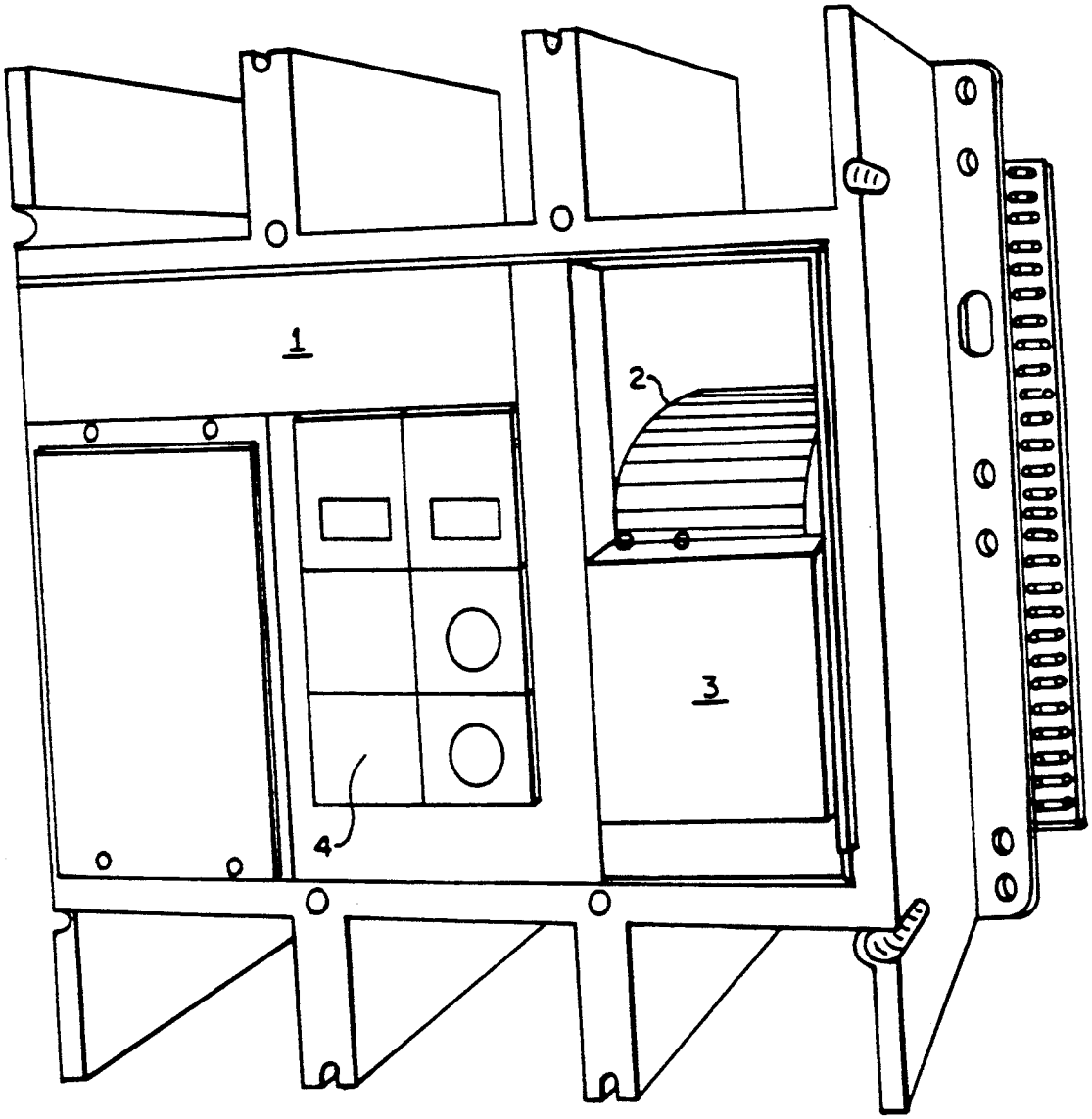
FIG. 1 is a perspective front view of a circuit breaker including the teachings of this invention.

Referring now to FIG. 1, there is shown a circuit breaker. Although the figure depicts that type of circuit breaker known in the art as a molded case circuit breaker, it is to be understood that the invention is likewise applicable to circuit breakers and transfer switches generally in which springs are charged as a consequence of the rotation of a shaft. Except for the charging mechanism, the circuit breaker 1 is of the type disclosed in U.S. Pat. No. 4,404,446, issued Sep. 13, 1983 and which is incorporated herein by reference.

The circuit breaker 1 includes a charging mechanism 2 adjacent to the latch and trip mechanism which resides beneath the control and indicator panel 4. The charging mechanism also includes a handle 3 by which the spring may be charged manually.

Figure 2:
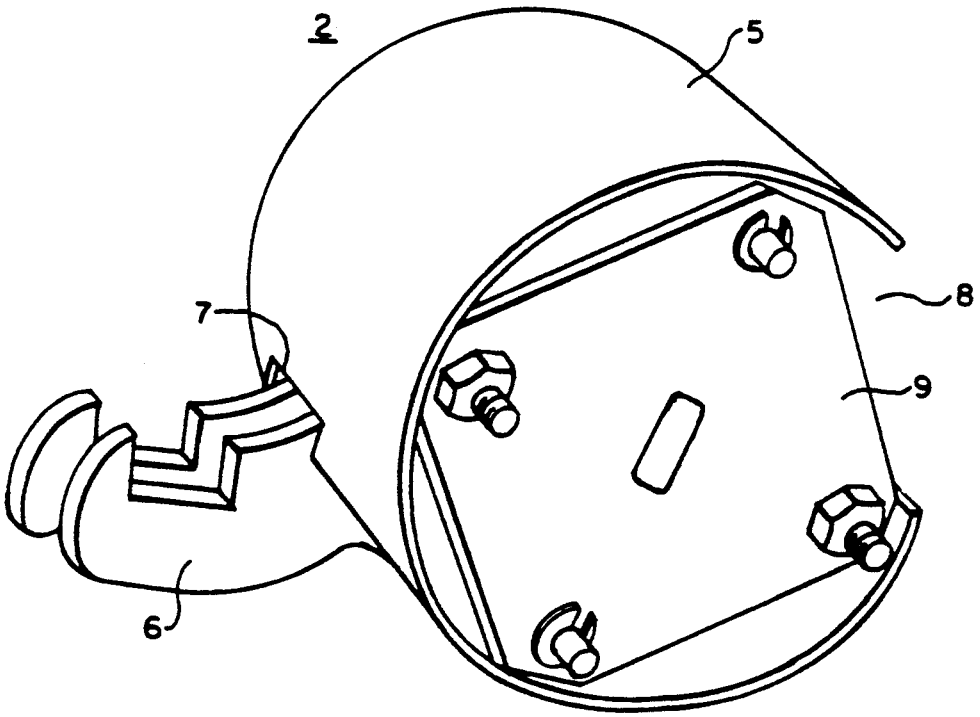
FIG. 2 is a perspective view of the spring charging mechanism within the circuit breaker depicted in FIG. 1.

Referring now to FIG. 2, the charging mechanism 2 is shown removed from the breaker. It is covered by an insulating sleeve 5 which serves to electrically insulate the internal parts of the charging mechanism from the region surrounding it, particularly the areas in front of the breaker in the vicinity of the handle. The insulating sleeve 5 has an opening 7 therein through which the ratchet handle members 6 protrude. The insulating sleeve 5 also has a longitudinal slot 8 therethrough such that when viewed endwise the insulating sleeve forms a "C" shape. The insulating sleeve is composed of a flexible resilient material such that it may be nondestructively flexed open at the longitudinal slot 8, allowing it to be installed or removed from the charging mechanism quickly and easily.

Figure 3:
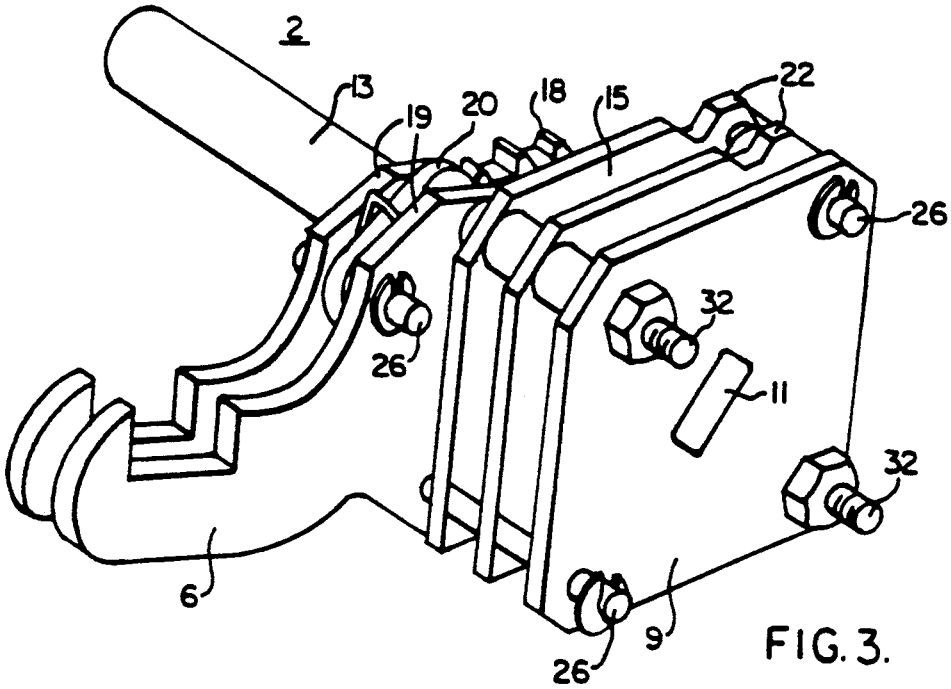
FIG. 3 is a perspective view of the same charging mechanism with its insulating sleeve removed to reveal its internal parts.

Referring now to FIG. 3, the charging mechanism 2 is shown with the insulating sleeve removed. In FIG. 3 a perspective view of the mechanism, including the hand drive ratchet plates 19 and integral ratchet handle members 6, the hand drive ratchet wheel 18, the motor ratchet plates 22 and the motor drive plate 9 with motor drive slot 11, can be seen. The charging shaft 13 is coupled to the latch and trip mechanism of the breaker (not shown). Rotation of the shaft in a clockwise direction relative to FIG. 3 will charge the breaker spring (not shown). The charging shaft 13 extends within the mechanism to a point short of the motor drive plate 9.

Figure 4:
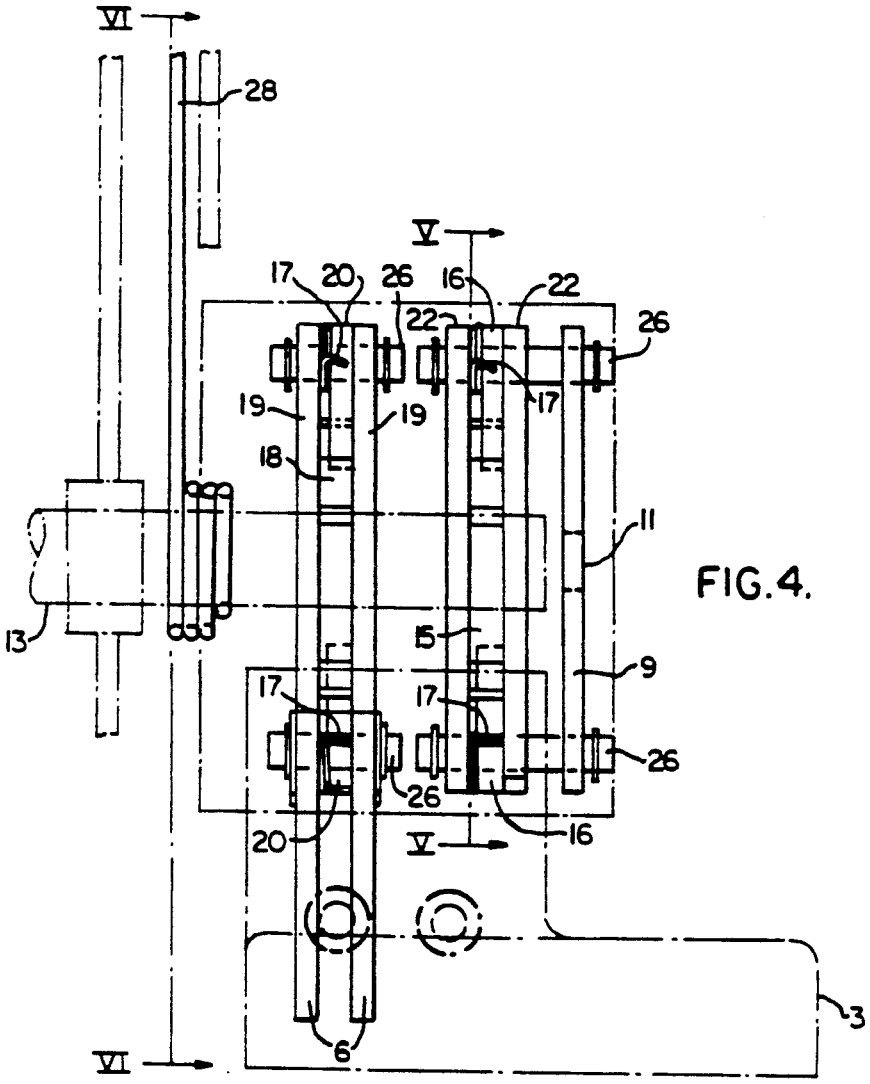
FIG. 4 is a top view of the charging mechanism of FIGS. 2 and 3.

FIG. 4 reveals a top view of the charging mechanism and the details of its construction. Beginning from the left of the figure, the charging shaft 13 exits the latch and trip mechanism of the breaker (not shown) and extends to a point short of the motor drive plate 9. Fixedly coupled to the charging shaft 13 are the hand drive ratchet wheel 18 and the motor drive ratchet wheel 15. A pair of hand drive ratchet plates 19 are located on either side of the hand drive ratchet wheel 18; these are not fixedly coupled to the charging shaft 13, but may rotate freely around it in a plane perpendicular to FIG. 4. The hand drive ratchet plates 19 are held in fixed position relative to each other by pawl pins 26 having "C" clips at their ends. Hand drive ratchet pawls 20 are also pivotally secured at the pawl pins 26. The hand drive ratchet pawls 20 are biased to contact the hand drive ratchet wheel 18 by pawl springs 17. The ratchet handle members 6 are integral to and extend from the hand drive ratchet plates 19.

A pair of motor drive ratchet plates 22 are similarly located on either side of the motor drive ratchet wheel 15, and are not fixedly coupled to the charging shaft 13 but may rotate freely around it in a plane perpendicular to FIG. 4. The motor drive ratchet plates 19 are held in a fixed position relative to each other by pawl pins 26 having "C" clips at their ends. Motor drive ratchet pawls 16 are also pivotally secured at the pawl pins 26. The motor drive ratchet pawls 16 are biased to contact the motor drive ratchet wheel 15 by pawl springs 17.

Finally, the motor drive plate 9 is bolted to the motor drive ratchet plates 22 by motor drive plate bolts (not shown) in a manner such that a turning force applied to the motor drive plate 9 will be transferred to the motor drive ratchet plates 22.

Figure 5:
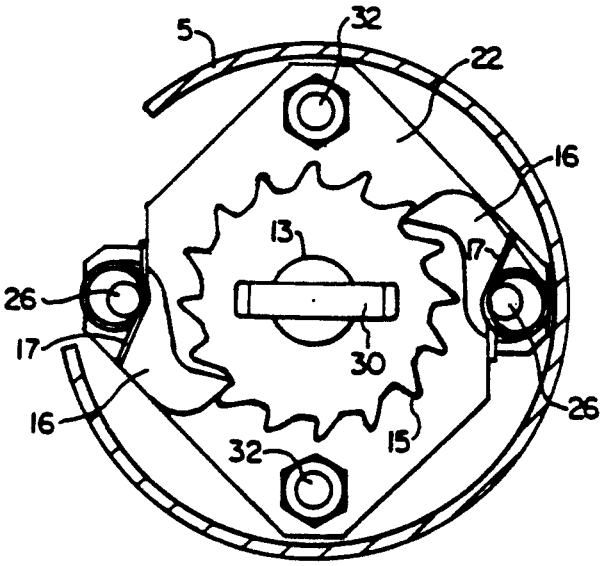
FIG. 5 is a view of Section V—V from FIG. 4.

FIG. 5 depicts Section V—V as noted in FIG. 4. FIG. 5 presents a side view of the motor drive ratchet wheel 15, one of the motor drive ratchet plates 22, and the motor drive ratchet pawls 16, which are biased against the motor drive ratchet wheel 15 by the pawl springs 17. The motor drive ratchet wheel 15 is fixedly coupled to the charging shaft 13 by a ratchet-shaft lock pin 30. The motor drive plate bolts 32 bolt to the motor drive ratchet plate 22 and also to the motor drive plate (not shown).

Thus, when a turning force is applied to the motor drive plate, this turning force is transferred through the motor drive plate bolts 32 to the motor drive ratchet plates 22. If the turning force is applied in a counterclockwise direction relative to FIG. 5, the turning force will be further transferred from the motor drive ratchet plates 22 to the motor drive ratchet wheel 15 through the motor drive ratchet pawls 16. Consequently, the turning force will be transferred from the motor drive ratchet wheel 15 to the charging shaft 13 through a ratchet-shaft lock pin 30. The charging shaft 13 may also rotate in a counterclockwise direction relative to FIG. 5 if the motor drive ratchet plates are held stationary, as allowed by the geometry of the motor drive ratchet wheel 15 as it interacts with the motor drive ratchet pawls 16.

Figure 6:
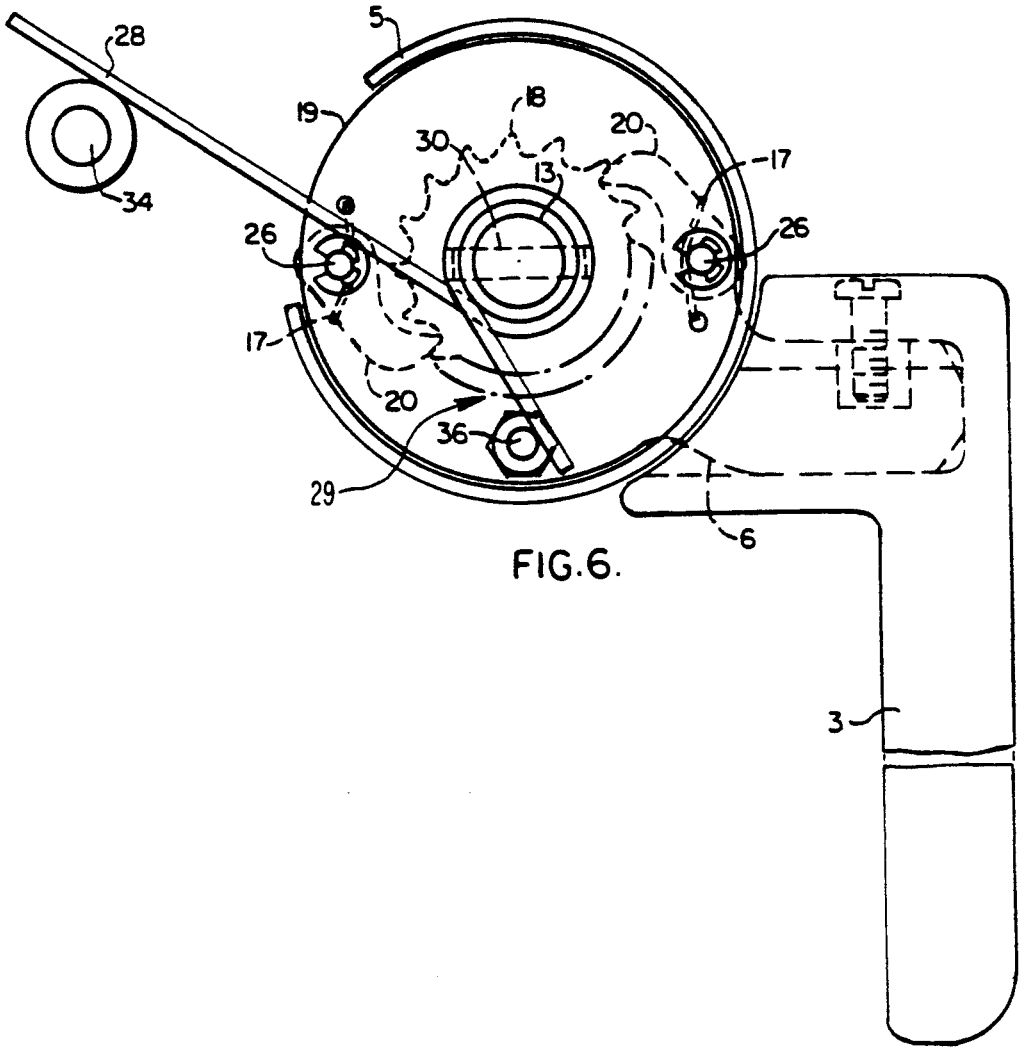
FIG. 6 is a view of Section VI—VI from FIG. 4.
Figure 7:
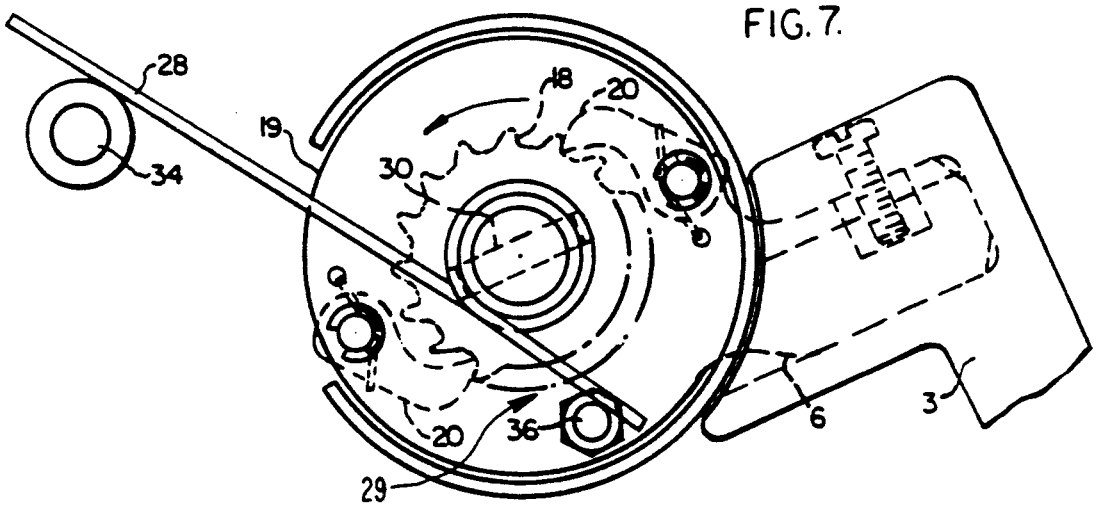
FIG. 7 is the same view of Section VI—VI, but depicting the charging mechanism partially cranked.

Refer now to FIGS. 6 and 7. These show Section VI-VI of the charging mechanism as noted in FIG. 4. The assembly of the hand drive ratchet plates 19, the hand drive ratchet pawls 20, and the hand drive ratchet wheel 18 is similar to the motor drive ratchet assembly in the description accompanying FIG. 5 above. The hand drive ratchet wheel 18 is also similarly fixedly coupled to the charging shaft 13 by a ratchet-shaft lock pin 30. The ratchet handle member 6 is integral to the hand drive ratchet plate 19. A handle 3 is fixed onto the ratchet handle member 6. Holding means 29 is provided by handle return spring 28, coiled about the charging shaft 13, which biases the handle 3 against the casing of the breaker (not shown) by exerting pressure on the return spring rest 36 and return spring stop 34.

Thus, it can be seen that when the bottom of handle 3 is pulled in a counterclockwise direction relative to FIG. 6 to the position shown in FIG. 7, turning forces are introduced in the hand drive ratchet plates 19. These turning forces are then transferred to the hand drive ratchet wheel 18 through the hand drive ratchet pawls 20, and ultimately to the charging shaft 13 through the ratchet-shaft lock pin 30. When the handle 3 is released by the operator, the return spring 28 acting on the return spring rest 36 will return the hand drive ratchet plates 19, and consequently the ratchet handle members 6 and handle 3 to their original resting positions. When the hand drive ratchet wheel 18 is held stationary, it can be seen that the geometry of the hand drive ratchet pawls 20, interacting with the hand drive ratchet wheel 18, permit the hand drive ratchet plates to rotate freely in a clock-wise direction relative to FIG. 6.

Returning now to FIGS. 3 and 4, the operation of the charging mechanism will be described. A motor-drive unit (not shown), having a gear-reduction unit and an output shaft, may be included in the breaker. The output shaft will have an end adapted to fit into the motor drive slot 11 of the motor drive plate 9. The gear ratios of the gear-reduction unit will be such as to disallow reverse rotation of the motor drive plate 9 arising from turning forces transmitted to the charging shaft 13 from the spring (not shown). The charging mechanism will be installed in the breaker. The handle 3 will rest under the influence of the handle return spring 28 against the casing of the breaker.

Thus, when the motor drive unit is activated, its output shaft will drive the motor drive plate 9 in a clockwise direction relative to FIG. 3. The turning moment thus developed in the motor drive plate 9 will be transferred through the motor drive plate bolts 32 to the motor drive ratchet plates 22, and subsequently to the charging shaft 13 through the motor drive ratchet pawls 16 acting on the motor drive ratchet wheel 15, which is fixedly coupled to the charging shaft 13. In this manner a motor drive unit may charge the breaker spring.

During motor-driven charging, the handle 3, the ratchet handle members 6, and consequently the hand drive ratchet plates 19 are stationary, the handle 3 resting against the breaker casing under influence of the handle return spring 28. The hand drive ratchet wheel 18, fixedly coupled to the charging shaft 13, is permitted to "freewheel" between the hand drive ratchet plates 19 by virtue of the geometry and interaction of the hand drive ratchet wheel 18 and the hand drive ratchet pawls 20.

Alternatively, the charging mechanism may be used to charge the breaker spring manually. The motor drive unit will remain inactive, the gear ratios in its gearbox preventing reverse rotation of the motor drive plate 9 and consequently the motor drive ratchet plates 22. Because of the interacting geometries of the motor drive ratchet wheel 15 and the motor drive ratchet pawls 16, reverse rotation of the motor drive ratchet wheel 15 and charging shaft 13 to which it is fixedly coupled, is also prevented. If a strictly manually-charged breaker is desired, the motor drive unit may be replaced by a holding bracket (not shown) which inserts into the motor drive slot 11 and mounts to the breaker casing, preventing rotation of the motor drive plate 9.

To manually charge the breaker, the operator pulls the handle 3, which results in a clockwise turning force relative to FIG. 3, being applied to the ratchet handle members 6 and consequently to the hand drive ratchet plates 19. This turning force will be transferred to the hand drive ratchet wheel 18 through the hand drive ratchet pawls 20, and consequently to the charging shaft 13, to which the hand drive ratchet wheel 18 is fixedly coupled. After a stroke of the handle 3, the operator releases it and it returns to its starting position under influence of the handle return spring 28. Reverse motion of the charging shaft when the handle is released is prevented by the interacting geometries of the motor drive ratchet wheel 15 and the motor drive ratchet pawls 16, the motor drive ratchet plates 22 to which the pawls 16 are attached being held stationary by the motor unit gearbox or a holding bracket inserted into the motor drive slot 11.

Finally, referring to FIGS. 8-12, the assembly of the handle 3 onto the ratchet handle members 6 is illustrated. As illustrated by FIG. 8, the rear of the handle 3 includes peripheral and internal ribbing. The handle 3 and screws 52 are necessarily constructed of plastic or other electrically insulating material so as to electrically insulate the metal parts of the charging mechanism from the operator. To couple the handle 3 to the ratchet handle members 6, a special geometry and key arrangement are used so as to relieve the screws 52 from destructive mechanical stresses arising from use.

Accordingly, the handle will have therein at least one recess 42 for receiving the ratchet handle members 6. The ratchet handle members 6 have a first notch 40 therein. Between the recesses 42 in the handle 3 is a locking spline 46. The locking spline 46 has a second notch 48 therein. When the ratchet handle members 6 are fully inserted into the right recess 42, the first notch 40 in the ratchet handle members 6 and the second notch 48 in the locking spline 46 align within the right recess to form a keyway. Screw bores 50 are located in the top of the handle 3 directly over the recesses 42 and in line with the second notch 48.

In order to assemble the handle 3 onto the ratchet handle members 61 a keyplate 38 is dropped into the first notch 40 in the ratchet handle members 6 as shown in FIGS. 10 and 11. The ratchet handle members 6 are then inserted into the right recess 42 as indicated by the arrows; there is a keyplate pass way 44 between the recesses 42 which permits the keyplate 38 to pass into the recesses 42. When the ratchet handle members 6 are fully inserted into the right recess 42, screws 52 are inserted into the screw bores 50, and turned to screw into tapped holes 54 in the key plate 38. As the screws 52 are tightened, the keyplate 38 is draw upwards into the second notch 48 as shown in FIG. 12. In this position, the key plate 38 serves to transfer the mechanical stresses created during use of the handle 3 between the locking spline 46 and the top of the first notch 40. Thus, mechanical shear stresses are not imposed on the screws 52 when the operator pulls the handle 3.

The device of the present invention provides certain new advantages, namely, amenability to manufacture by inexpensive stamping methods, easy adaptability for motor-driven or manual charging or both, and flexibility of installation on any spring-driven breaker or switch in which the spring is charged by the unidirectional rotation of a shaft.

I claim:

1. An electrical apparatus providing a rotational spring-charging force for a switching device having a rotatable shaft, said apparatus comprising:

first ratchet means coupled to said shaft for rotating said shaft in a direction in response to a first applied force;

second ratchet means coupled to said shaft for rotating said shaft in said direction in response to a second applied force, said second ratchet means being situated such that said second ratchet means may rotate entirely about said shaft in a path unobstructed by said first ratchet means; and holding means disposed in relation with said first ratchet means and said second ratchet means for holding one of said ratchet means immobile as the other said ratchet means actuates rotation of said shaft.

2. The apparatus of claim 1 wherein said first applied force is a manually applied force.

3. The apparatus of claim 2 comprising handle means extending from said first ratchet means for applying said first applied force.

4. The apparatus of claim 3 wherein said handle means comprises:

a member extending from said first ratchet means, and a handle situated on said member.

5. The apparatus of claim 3 wherein said handle means comprises:

a member extending from said first ratchet means, said member having a first notch therein;

a handle with a recess into which said member is inserted, said handle having a second notch within said recess located opposite said first notch and cooperative therewith to form a keyway; and a keyplate disposed in said keyway.

6. The apparatus of claim 5 further comprising retaining means disposed in relation to said keyway and said keyplate for retaining said keyplate in said keyway.

7. The apparatus of claim 3 further comprising flexible resilient electrically insulating sleeve means, said sleeve means having a longitudinal slot for sliding over and substantially surrounding said first and second ratchet means and said shaft.

8. The apparatus of claim 7 wherein said sleeve means has an opening therein through which said handle means protrudes.

9. An electrical apparatus providing a rotational spring-charging force for a switching device, said apparatus comprising:

a rotating shaft;

an actuator interconnected to and rotating said shaft to perform a useful function;

a member extending from said actuator, said member having a first transverse notch therein;

a handle with a recess into which said member is inserted, said handle having a second transverse notch within said recess, said second transverse notch aligned with said first transverse notch to form a keyway;

a keyplate resting within said first transverse notch of said member; and means to draw said keyplate into said second transverse notch of said handle while said keyplate remains engaged in said first transverse notch of said member; and flexible resilient electrically insulating sleeve means, said sleeve means having a longitudinal slot for sliding over and substantially surrounding said actuator and said shaft.

10. The apparatus of claim 9 wherein said sleeve means has an opening therein through which said member protrudes.

11. An electrical apparatus comprising:

a rotating shaft;

an actuator interconnected to and rotating said shaft to perform a useful function; and flexible resilient electrically insulating sleeve means, said sleeve means having a longitudinal slot for sliding over and substantially surrounding said actuator and said shaft, said sleeve means also having a separate opening therein through which a member may protrude from said actuator so that said sleeve means rotates with said shaft and said actuator.

* * * * *